United States Patent [19]

Jackson

[11] Patent Number: 5,036,549

[45] Date of Patent: Aug. 6, 1991

[54] COMBINATION VEST-SUSPENDERS GARMENT

[76] Inventor: Garnitta C. Jackson, 874 Linwood Rd., Memphis, Tenn. 38116

[21] Appl. No.: 558,224

[22] Filed: Jul. 26, 1990

[51] Int. Cl.[5] ..... A41D 1/04

[52] U.S. Cl. ..... 2/102; 2/326; 2/327; 2/328

[58] Field of Search ..... 2/102, 323, 326, 327, 2/328, 230, 236, 237; D2/190, 183

[56] References Cited

U.S. PATENT DOCUMENTS

| | | | |
|---|---|---|---|
| 970,824 | 9/1910 | Hoppenstein | 2/102 |
| 1,009,109 | 11/1911 | Steefel | 2/102 |
| 1,118,572 | 11/1914 | Nigh | 2/102 |
| 1,475,072 | 11/1923 | Langerman | 2/102 |
| 1,880,779 | 10/1932 | Cahn | 2/326 |
| 1,910,131 | 5/1933 | Shields | 2/326 |
| 3,579,639 | 5/1971 | Faulkner | 2/326 |
| 3,793,645 | 2/1974 | Kadison | 2/237 |

FOREIGN PATENT DOCUMENTS

| | | | |
|---|---|---|---|
| 14594 | 11/1918 | United Kingdom | 2/326 |

*Primary Examiner*—Werner H. Schroeder
*Assistant Examiner*—Gloria Hale
*Attorney, Agent, or Firm*—John J. Mulrooney

[57] ABSTRACT

A combination vest-suspenders garment includes full front vest portions which meet in the front and button down the center, which taper at their upper ends to form relatively narrow shoulder portions and which flare outwardly in the traditional manner towards the waistline to a relatively wide waist area having side edges. Suspenders straps are connected to the shoulder portions and extend downwardly and rearwardly to approximately the middle of the back where they cross, and then extend further downwardly to ends at waist level where they have suspender snaps thereon for connection to trousers or skirts. A back band is made of a fabric gathered over a single elastic band which extends continuously across the back waist from the side edge of one front portion to the side edge of the other front portion. In an alternative embodiment, the suspender straps extend from the shoulder portions to the middle of the back where they are joined and from that point a single suspender strap extends to an end at waist level where a suspender snap thereon connects the suspenders to the trousers or skirt. In an alternative embodiment, the back band includes two parts which meet at the middle of the back waist where they are joined by a button.

5 Claims, 3 Drawing Sheets

COMBINATION VEST-SUSPENDERS GARMENT

BACKGROUND OF THE INVENTION

This invention relates to clothing and, in particular, to a combination vest-suspenders garment.

Combination vest and suspenders garments are known. However, the traditional approach to the design of such garments has been to combine the suspenders with the vest in a manner whereby the suspenders provide merely a support function for the trousers or skirt and wherein the suspenders are not prominently displayed to perform both a useful function and a design function. See, for example, U.S. Pat. Nos. 1,118,572; 1,902,939; and Des. 271,345. With these prior art combination garments, the suspenders usually cannot be seen beneath a full vest, which prevents any opportunity for using colorfully-designed suspenders as part of a fashionable vest-suspenders combination garment.

Accordingly, it is a general object of this invention to provide a new, useful and improved combination vest-suspenders garment.

Another object of this invention is to provide an improved combination vest-suspenders garment which can be worn by males and females, and which has a full vest portion in front and a colorfully-designed suspenders in back, secured by a back band, whereby the garment gives a flattering, contemporary appearance to the traditional combination vest and suspenders garment.

Another object of this invention is to provide a combination vest-suspenders garment designed to fashionably display both the vest portion and the suspenders portion and which uses a variety of fabrics for the vest portion and suspenders portion for year-round comfort and for both dressy or casual attire.

Another object of this invention is to provide an improved combination vest-suspenders garment having a design that insures that the garment is bulge-free in the bodice section of the vest.

These and other objects are attained in the present invention in the form of an improved combination vest-suspenders garment having a full traditional vest front including flaps which taper at their upper ends to form shoulder parts and which meet and are joined by buttons at the middle. Suspender straps are attached to the shoulder portions of the flaps and extend downwardly across the back where they are joined to the trousers with suspender snaps. A back band extends across the wearer's back waist from the rear edge of one front flap to the rear edge of the other front flap and covers the suspender snaps attached to the trousers.

DESCRIPTION OF THE PREFERRED EMBODIMENTS

Figure 1:
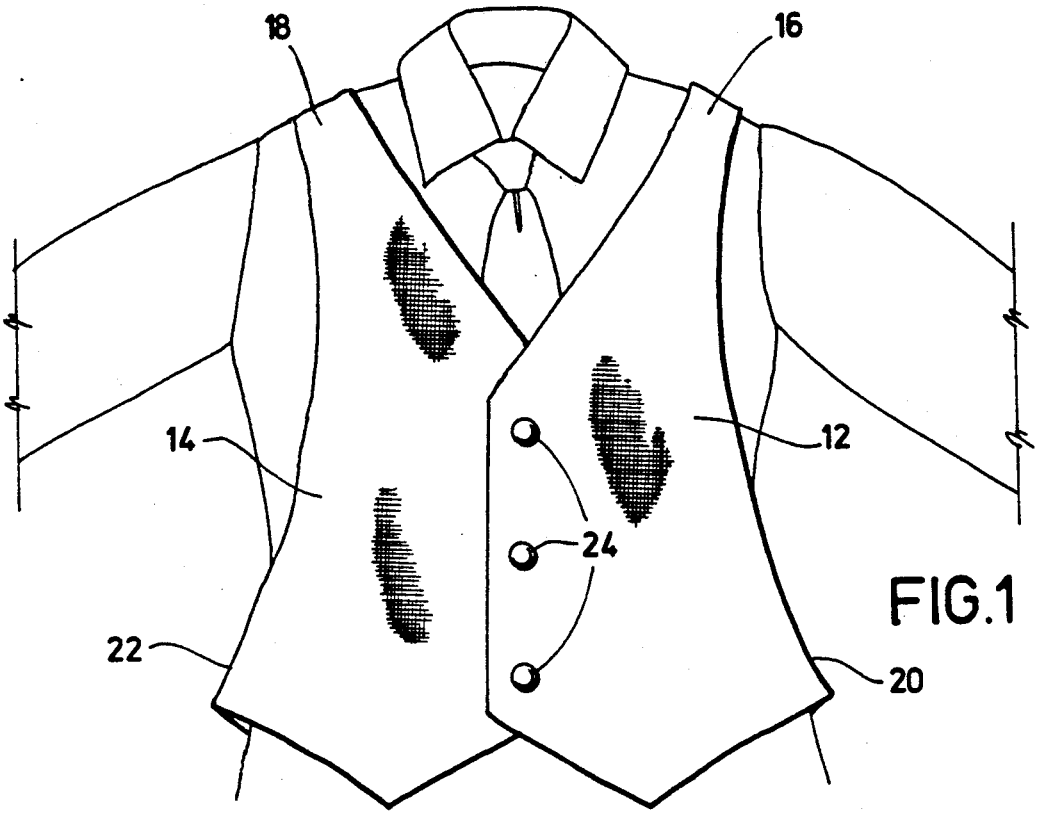
FIG. 1 is a front elevational view of one embodiment of the invention.
Figure 2:
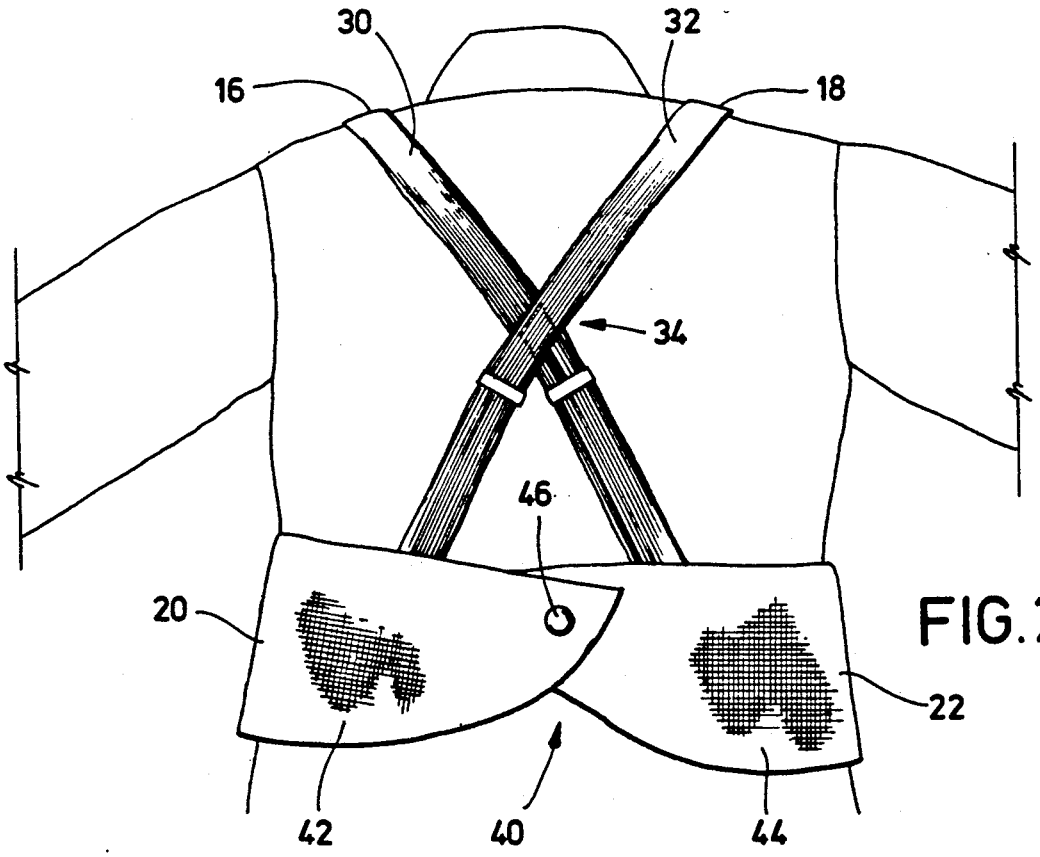
FIG. 2 is a rear elevational view of the embodiment of the invention illustrated in FIG. 1.
Figure 3:
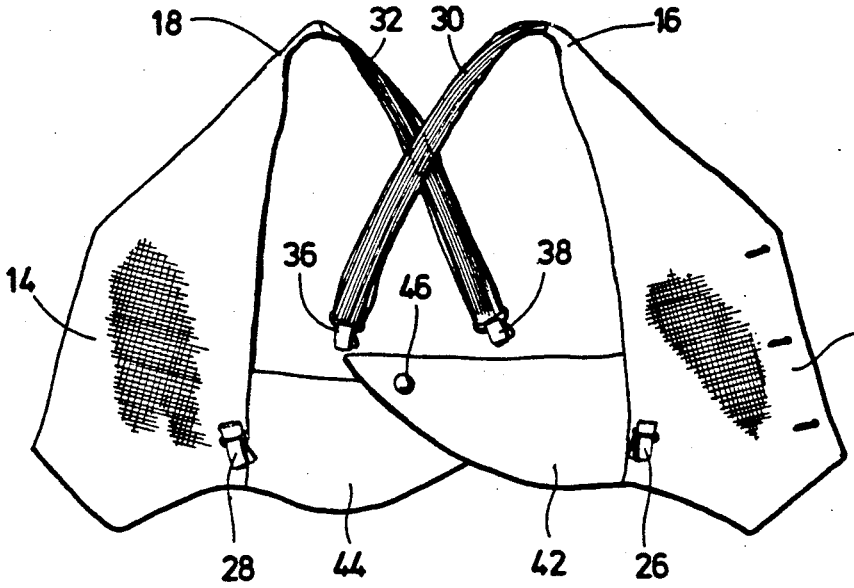
FIG. 3 is a front elevational view of the embodiment of the invention illustrated in FIG. 1 showing the vest front flaps in an open position.

Referring to FIGS. 1, 2 and 3 of the drawings, a first embodiment is illustrated. The new and improved combination vest-suspenders garment includes a traditional vest front having front side flaps 12 and 14, which taper at their upper ends to form relatively narrow strap-like shoulder parts 16 and 18, and which flare outwardly in the traditional manner towards the waistline to form a relatively wide waist-area having side edges 20 and 22. The front flaps 12 and 14 meet at the middle where they are fastened by buttons 24.

Suspender straps 30 and 32 are attached to the front flap shoulder parts 16 and 18 respectively (FIG. 2). The suspender straps 30 and 32 and extend downwardly and rearwardly from the shoulder parts, cross in the midsection of the back as indicated at 34 and extend to the rear waist area where suspender snaps 36 and 38 (FIG. 3) are attached to the ends of suspender straps 30 and 32 respectively. The suspender straps 30 and 32 may be connected or stitched at 34, if desired.

Referring to FIGS. 2 and 3, the combination garment has a back band which extends from the lower waist-area, side edge of each front flap around the back of the wearer. The back band, which is indicated generally by the numeral 40, includes a back flap or portion 42 which is connected to front flap 12 at side edge 20 and a back flap or portion 44 which is connected to front flap 14 at side edge 22. The back flaps 42 and 44 are fashionably contoured as shown and extend to the middle of the wearer's back where they are fastened by means such as a button 46. The back band 40 functions to conceal the suspender snaps 36 and 38 which will be attached to the trousers or skirt, while permitting the fashionably designed suspender straps 32 and 30 to remain visible. The back band 40 also insures a snug fit of the garment on the wearer's body.

Figure 4:
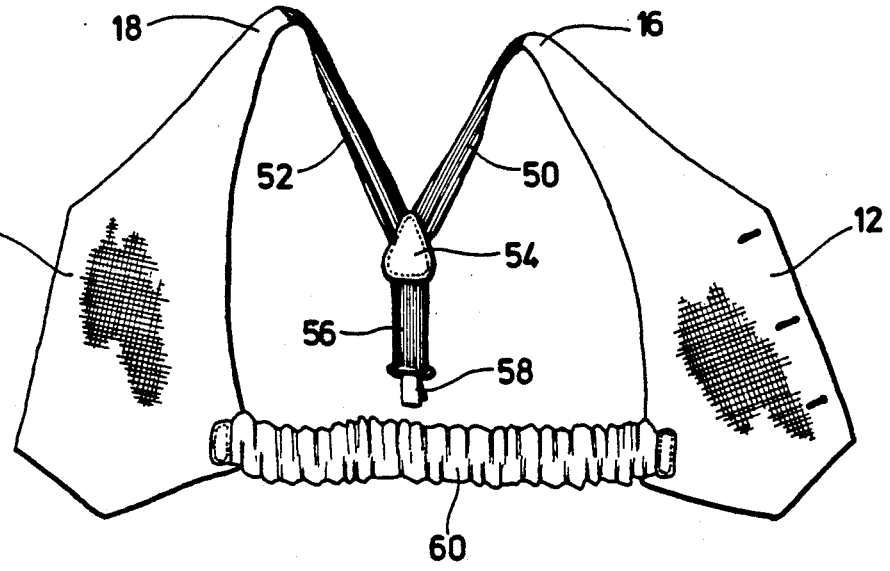
FIG. 4 is a front elevational view of a second embodiment of the invention showing the vest flaps in an open position.
Figure 5:
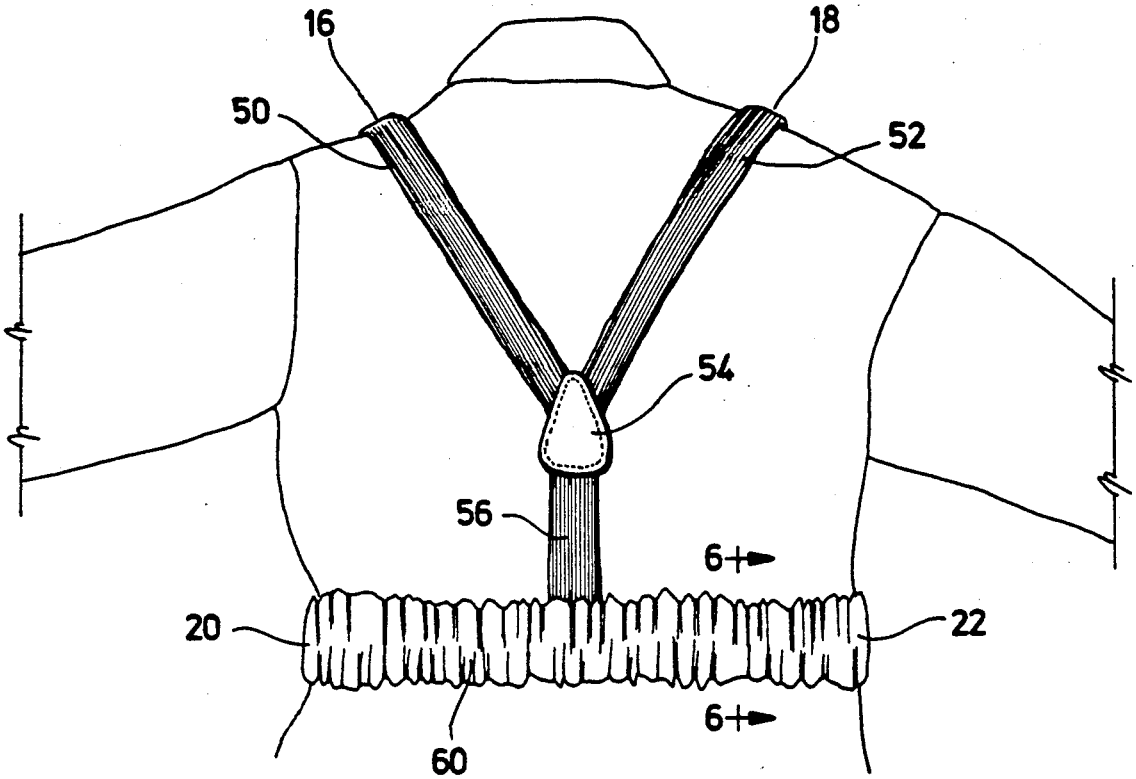
FIG. 5 is a rear elevational view of the embodiment of the invention illustrated in FIG. 4.
Figure 6:
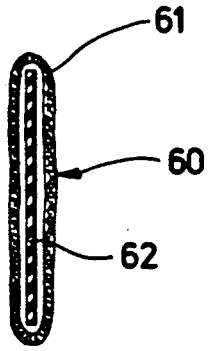
FIG. 6 is a sectional view taken along the line 6—6 in FIG. 5.

Referring now to FIGS. 4 and 5, a second or alternative embodiment of the combination vest-suspenders garment invention is illustrated. This embodiment is identical in construction to the embodiment illustrated in FIGS. 1, 2 and 3 with respect to the traditional front or vest portion of that embodiment, and differs only with respect to the construction of the suspenders and back band parts. As can be seen in FIGS. 4 and 5, suspender straps 50 and 52 extend rearwardly and downwardly from the shoulder parts 16 and 18 respectively of the front vest flaps 12 and 14. The suspender straps 50 and 52 extend to a mid-point of the back 54 where they are joined and a single suspender strap 56 extends downwardly therefrom to the waist-area, and a suspender snap 58 is attached at the end of strap 56. In this embodiment, a back band 60 is made of fabric 61 which is gathered over an elastic band 62 which extends from the side edge 20 of front flap 12 around the back of the wearer to the side edge 22 of the other flap 14.

In addition to contributing to the unique combination of a visible vest and suspenders combination garment, the back band provides a distinctive feature to the garment. While helping to eliminate bulging or sagging, the back band also gives a look of balance and completeness to the garment's back appearance. Without the inclusion of the band, the suspenders would place a strain on the vest fabric causing bulging. The back band gives the garment a neat and attractive appearance while insuring a more comfortable fit.

It can be seen from the foregoing that this invention provides a new, useful and fashionable adaptation of a combination vest and suspenders garment, which can be worn by males and females. The full vest in front and visible suspenders and back band in the rear provide the garment with a large capacity for combining colors and fabrics to provide many colorfully-designed combination garments which give a flattering, contemporary appearance. The combination garment allows vest and suspender wearers to wear both garments simultaneously, in a useful and fashionable variety of colors, prints and fabrics.

Although the invention has been described and illustrated with respect to preferred embodiments thereof, it is not to be so limited since changes and modifications may be made therein which are within the full intended scope of the invention.

What is claimed is:

1. A combination vest-suspenders garment comprising a vest front having a pair of front flaps which taper at their upper ends to form relatively narrow shoulder straps and which flare at their bottoms to form relatively wide waist areas having side edges, and which meet and are joined by buttons at the middle; first and second suspender straps connected to said shoulder parts and extending rearwardly and downwardly therefrom to a point at approximately the middle of the back where said suspender straps cross and extend further downwardly to the back waist-area and terminate in ends to which suspender snaps are connected, said suspender snaps being attached to the waist of a nether garment and a back band extending from the side edge of one front flap rearwardly across the back waist and around to the side edge of the other front flap and covering said back waist area where said suspender snaps are attached to said nether garment thereby covering said suspender snaps.

2. The combination vest-suspenders garment of claim 1 wherein said first and second suspender straps connected to said shoulder parts extend rearwardly and downwardly to a point at approximately the middle of the back where said suspender straps are joined; a single suspender strap extending downwardly from said point to the back waist area and terminating in an end; a suspender snap connected to said single suspender strap end and attached to the waist of a nether garment; and said back band includes a first part which extends from the side edge of one front flap around the back waist to the middle and a second part which extends from the side edge of the other front flap to the middle where said back band first and second parts meet and are joined by a button, said back band covering said back waist area where said suspender snap is attached to said nether garment thereby covering said suspender snaps.

3. The combination vest-suspenders garment of claim 1 wherein said back band is a piece of fabric which is gathered over an elastic band which extends from the side edge of one front flap around the back waist of the wearer to the side edge of the other front flap, said back band covering said back waist area where said suspender snaps are attached to said nether garment thereby covering said suspender snaps.

4. The combination vest-suspenders garment of claim 1 wherein nether garment comprises trousers.

5. The combination vest-suspenders garment of claim 1 wherein said nether garment comprises a skirt.

* * * * *

US005036549B1

REEXAMINATION CERTIFICATE (4011th)

United States Patent [19]

Jackson

[11] B1 5,036,549

[45] Certificate Issued Mar. 14, 2000

[54] COMBINATION VEST-SUSPENDERS GARMENT

[75] Inventor: Garnitta C. Jackson, 874 Linwood Rd., Memphis, Tenn. 38116

[73] Assignee: Garnitta C. Jackson, Memphis, Tenn.

Reexamination Request:
No. 90/004,500, Dec. 9, 1996

Reexamination Certificate for:

| | |
|---|---|
| Patent No.: | **5,036,549** |
| Issued: | **Aug. 6, 1991** |
| Appl. No.: | **07/558,224** |
| Filed: | **Jul. 26, 1990** |

[51] Int. Cl.[7] ..... A41D 1/04

[52] U.S. Cl. ..... 2/102; 2/326; 2/327; 2/328

[58] Field of Search ..... 2/102, 326, 327, 2/328, 230, 236, 237; D2/190, 183

[56] References Cited

U.S. PATENT DOCUMENTS

| | | | |
|---|---|---|---|
| D. 271,345 | 11/1983 | Banks | D2/184 |
| 970,824 | 9/1910 | Hoppenstein | 2/102 |
| 1,009,109 | 11/1911 | Steefel | 2/102 |
| 1,118,572 | 11/1914 | Nigh | 2/102 |
| 1,475,072 | 11/1923 | Langerman | 2/102 |
| 1,902,939 | 3/1933 | Adler et al. | 2/102 |
| 1,910,131 | 5/1933 | Shields | 2/326 |
| 3,579,639 | 5/1971 | Faulkner | 2/326 |
| 3,793,645 | 2/1974 | Kadison | 2/221 |

FOREIGN PATENT DOCUMENTS

| | | | |
|---|---|---|---|
| 14594 | 11/1918 | United Kingdom | 2/326 |

*Primary Examiner*—Gloria M. Hale

[57] ABSTRACT

A combination vest-suspenders garment includes full front vest portions which meet in the front and button down the center, which taper at their upper ends to form relatively narrow shoulder portions and which flare outwardly in the traditional manner towards the waistline to a relatively wide waist area having side edges. Suspenders straps are connected to the shoulder portions and extend downwardly and rearwardly to approximately the middle of the back where they cross, and then extend further downwardly to ends at waist level where they have suspender snaps thereon for connection to trousers or skirts. A back band is made of a fabric gathered over a single elastic band which extends continuously across the back waist from the side edge of one front portion to the side edge of the other front portion. In an alternative embodiment, the suspender straps extend from the shoulder portions to the middle of the back where they are joined and from that point a single suspender strap extends to an end at waist level where a suspender snap thereon connects the suspenders to the trousers or skirt. In an alternative embodiment, the back band includes two parts which meet at the middle of the back waist where they are joined by a button.

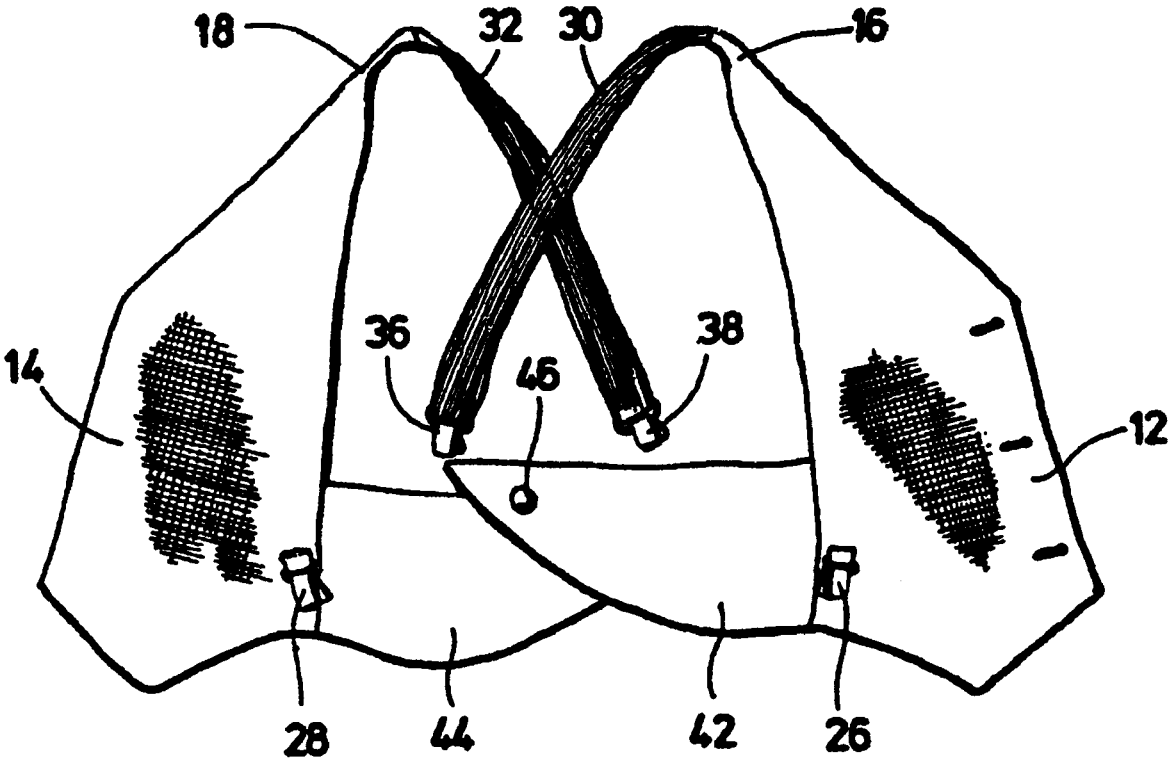

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 4 are determined to be patentable as amended.

Claims 3 and 5, dependent on an amended claim, are determined to be patentable.

1. A combination vest-suspenders garment comprising a vest front having a pair of front flaps which taper at their upper ends to form relatively narrow shoulder straps and which flare at their bottoms to form relatively wide waist areas having side edges, and which meet and are joined at the middle; first and second suspender straps connected to said shoulder [parts] *straps* and extending rearwardly and downwardly therefrom to a point at approximately the middle of the back where said suspender straps cross and extend further downwardly to the back waist area and terminate in ends to which suspenders snaps are connected, said suspender snaps being attached to the waist of a nether garment and a back band extending from the side edge of one front flap rearwardly across the back waist and around to the side edge of the other front flap and covering said back waist area where said suspender snaps are attached to said nether garment thereby covering said suspender snaps.

2. The combination vest-suspenders garment of claim 1 wherein said first and second suspender straps connected to said shoulder [parts] *straps* extend rearwardly and downwardly to a point at approximately the middle of the back where said suspender straps are joined; a single suspender strap extending downwardly from said point to the back waist area and terminating in an end; a suspender snap connected to said single suspender strap end and attached to the waist of a nether garment; and said back band [includes] *including* a first part which extends from the side edge of one front flap around the back waist to the middle and a second part which extends from the side edge of the other front flap to the middle where said back band first and second parts meet and are joined by a button, said back band covering said back waist area where said suspender snap is attached to said nether garment thereby covering said suspender [snaps] *snap*.

4. The combination vest-suspenders garment of claim 1 wherein *said* nether garment comprises trousers.

* * * * *